United States Patent [19]

Snook

[11] 4,173,923

[45] Nov. 13, 1979

[54] METAL AND BRICK CHIMNEY LINER

[75] Inventor: Randolph W. Snook, Shawnee Mission, Kans.

[73] Assignee: Pullman Incorporated, Chicago, Ill.

[21] Appl. No.: 958,076

[22] Filed: Nov. 6, 1978

Related U.S. Application Data

[63] Continuation of Ser. No. 835,900, Sep. 23, 1977, abandoned.

[51] Int. Cl.[2] ..... E04F 17/02; F23L 17/02

[52] U.S. Cl. ..... 98/58; 52/218; 52/219; 126/318

[58] Field of Search ..... 98/58, 59, 60; 52/218, 52/219; 126/307, 314, 120, 121, 318

[56] References Cited

U.S. PATENT DOCUMENTS

| | | | |
|---|---|---|---|
| 2,539,177 | 1/1951 | Baylor | 52/218 |
| 2,573,195 | 10/1951 | Gunderson | 52/218 |

*Primary Examiner*—Ronald C. Capossela

*Attorney, Agent, or Firm*—Richard J. Myers

[57] ABSTRACT

An insulated metal chimney lining, having constant loading spring suspension from the chimney column, is provided at the lower portion of a brick chimney lining to form the breeching entry. To provide additional thermal expansion capacity, an expansion joint may be incorporated in the metal liner.

22 Claims, 4 Drawing Figures

METAL AND BRICK CHIMNEY LINER

This is a continuation of Ser. No. 835,900, filed Sept. 23, 1977 abandoned.

This invention relates to chimneys having an outer column, usually of reinforced concrete and an inner liner. In particular it relates to the provision of metal breeching entries to be used with inner brick liners.

The present requirements for pollution control often require flue gas scrubbing techniques. Any unprotected steel chimney liners may be subject to corrosion and therefore, coated steel liners are required. To avoid the need for such coated liners acid brick construction has been employed for tall chimney linings. However, the design and construction of brick linings is not too satisfactory, especially where there are large breeching openings. Severe cracking and structural problems are caused by the discontinuities occasioned by the presence of the breeching openings and stresses in the brick piers due to non-uniform openings and stresses in the brick piers due to non-uniform thermal gradients. In addition the differential temperature effects cause large lateral displacements at the top of the chimney, which are difficult to restrain because of the high forces involved.

The present invention overcomes the problems of the brick liners while retaining the advantages thereof by combining the brick liner with an insulated steel breeching entry and liner. As a result, rational steel construction design can be used instead of largely empirical brickwork design in the breeching region, lateral deflection at the top of the brick lining caused by non-uniform thermal expansion is reduced, high compressive stresses at the side of the breech openings are eliminated, a smaller chimney foundation is required since the overall chimney is lighter in weight, and useable space is made available at the base of the chimney.

Thus it is an object of the present invention to improve the design of acid brick liners to correct their severe cracking and structural problems.

It is a further object to provide a brick liner having a lower portion and breeching entry made of steel, or plastic or other corrosion resistant material which is suspended so as to eliminate high compressive stresses at the sides of the opening and acts to reduce the lateral deflections at the top of the brick liner.

Further objects will be apparent from the rest of the specification and drawing.

These objects are obtained by suspending a steel liner and breeching entry at the lower part of the brick liner by fasteners which are connected to a circular ring beam supported on the chimney column, and by constant load spring hangers located at the top of the breeching duct where it passes through the concrete chimney column. The purpose of these spring hangers is to load the ring beam as uniformly as possible. Since most of the gas temperature imbalance exists in the vicinity of the suspended breeching, the lateral deflections at the top of the brick lining are greatly reduced. The portion of the liner in the vicinity of the breeching opening is in tension, eliminating high compressive stresses thereat. An expansion joint may be included to give additional thermal expansion capacity to the liner.

In the accompanying drawing:

FIG. 1 is cross sectional view of the lower portion of the chimney.

FIG. 2 a cross sectional view similar to FIG. 1 but showing a modification of the breeching portion only.

Figure 1:
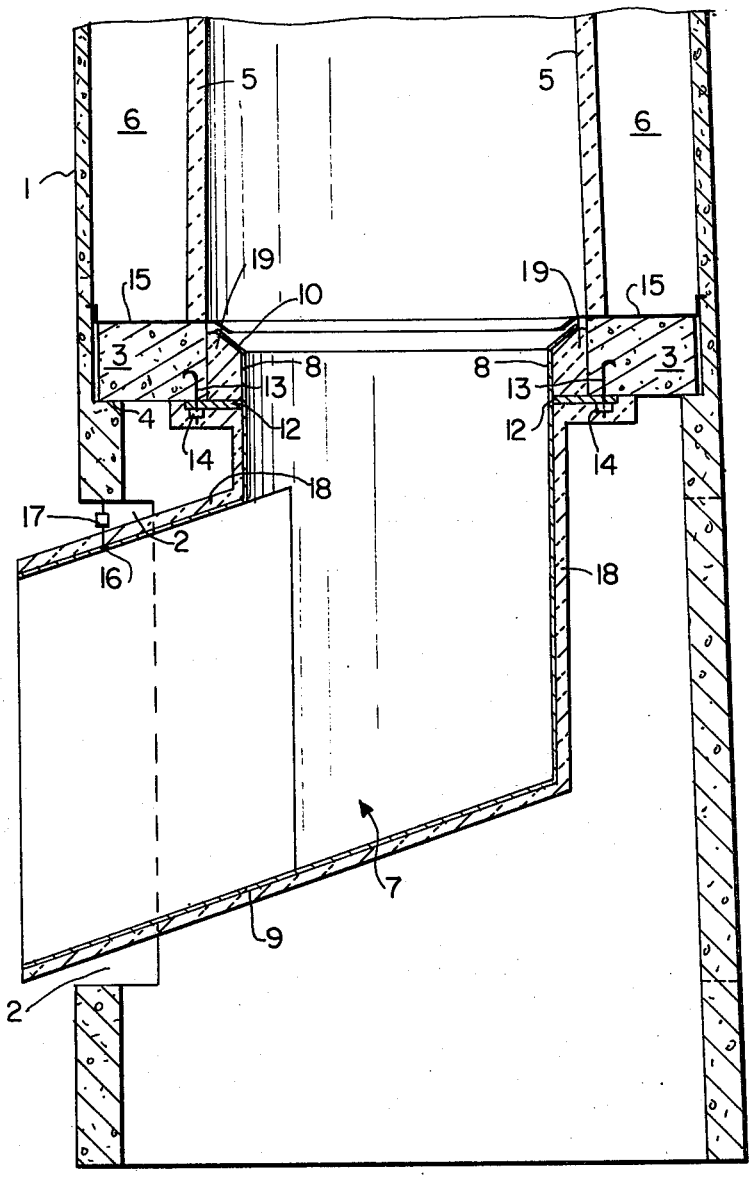

The present invention, as seen from FIG. 1, includes a conventional chimney column 1, generally of reinforced concrete, having at its lower portion a breeching opening 2. Above opening 2 is a reinforced concrete circular ring beam 3 which is seated on a circular corbel 4 as shown in the figure. A chimney liner 5 of acid brick construction is built on the ring beam 3, separated from chimney column 1 by space 6 which may be pressurized or kept at ambient conditions, as desired.

Fastened to circular ring beam or base 3 is a steel liner and breeching entry 7 consisting of a vertical portion 8 and a lateral breeching duct element 9 which extends through breeching opening 2 in chimney column 1. The upper end of 8 is flared out to form a collar as shown at 10, and its diameter is somewhat less than that of the inner diameter of the circular ring beam. From the figure it will be seen that the upper end of 10 is slightly below the top of the circular ring beam and seats over portion 19 of the ring beam. A ring plate 12 is fastened near the upper portion of 8, as by welding, and is attached to anchor bolts 13, cast in ring beam 3. The bolts pass through corresponding holes in ring plate 12, which is fastened by nuts and washers 14. The diameters of the holes are made sufficiently larger than the bolt diameters and the nuts are so tightened as to permit degree of sliding movement between ring plate 12 and the underside of ring beam 3 to permit radial thermal expansion. Lead or similar flashing 15 overlap the top of the flared portion 10, the upper part of the circular ring beam and has its end embedded in the inner wall of the chimney column as shown in the figure. It will be noted that the brick liner is laid on top of the flashing. It is apparent that some motion of the upper portion of 8 relative to ring beam 3 and brick liner 5 may take place and thus accommodate thermal strains.

Lateral portion 9 is suspended at location 16 from the concrete chimney column 1 at the upper part of the breeching opening 2 by constant load spring hangers 17 (only one shown). The hangers are attached to 1 and 9 by means (not shown) which permit pivoting motion, such as a clevis or the like, whereby motion of the steel liner 7 due to temperature changes may be accomodated and reduce eccentric loads on the circular beam caused by the weight of the breeching.

The outer portion of 7 is coated with insulation such as fiberglass, mineral wool or the like shown as 18. Similarly, the space between the inner portion of ring beam 3, ring plate 13 and the upper part of 8 is filled with insulation.

The liner shown is generally constructed of carbon steel, but other steels may be employed. For strength and rigidity it is externally stiffened as by having angles or other structural shapes (not shown) welded thereon. Instead of steel, other material may be employed to meet special requirements, such as plastics or other materials which are corrosion resistant and can withstand the other conditions of operation.

Figure 2:
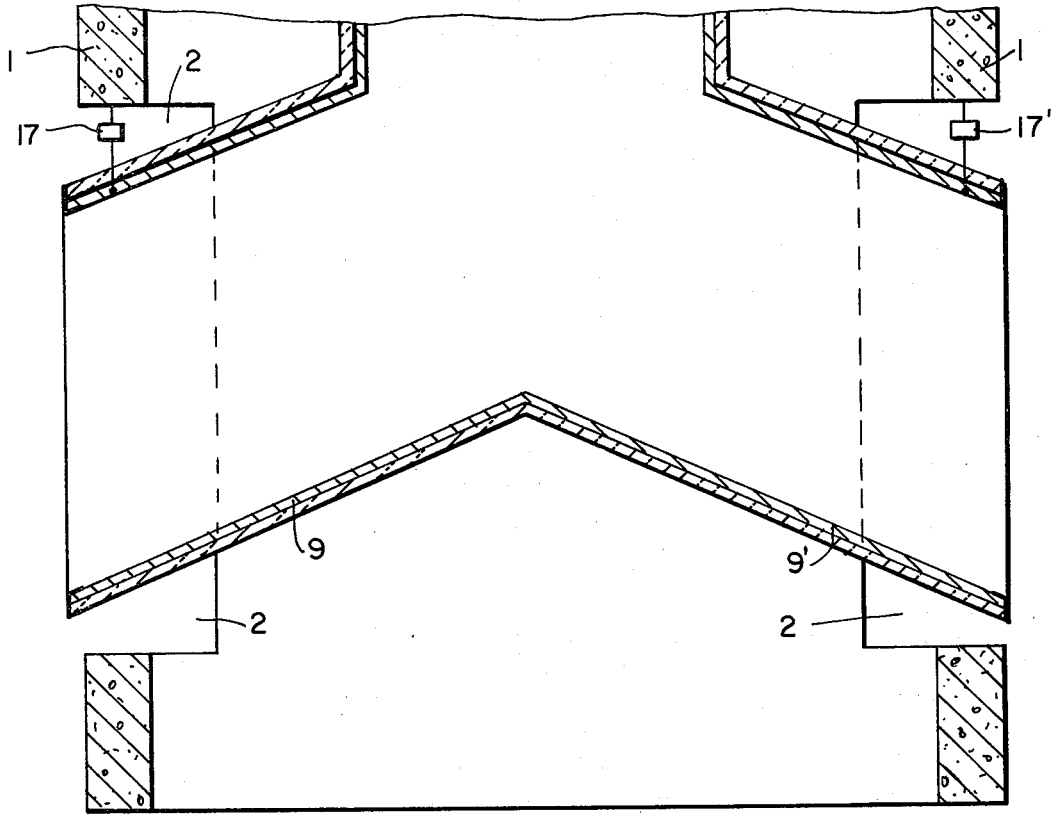

While the lateral portion 9 is shown as being at a slight angle from the horizontal, this may be varied to from substantially horizontal to a steeper incline. Although FIG. 1 shows a single breeching entry, more than one entry may be provided. This is illustrated by FIG. 2, where two opposing lateral breeching duct elements 9 and 9' are shown. Duct 9' is shown connected to column 1 by a spring hanger 17' which is identical with element 17. While this Figure shows two breeching entries, it should be obvious to one skilled in the art that addition entries may be provided as needed. No eccentric loading is placed on the circular ring beam when the liner and breaching entries form a unit which is symetrical or substantially evenly balanced about its vertical axis.

Figure 3:
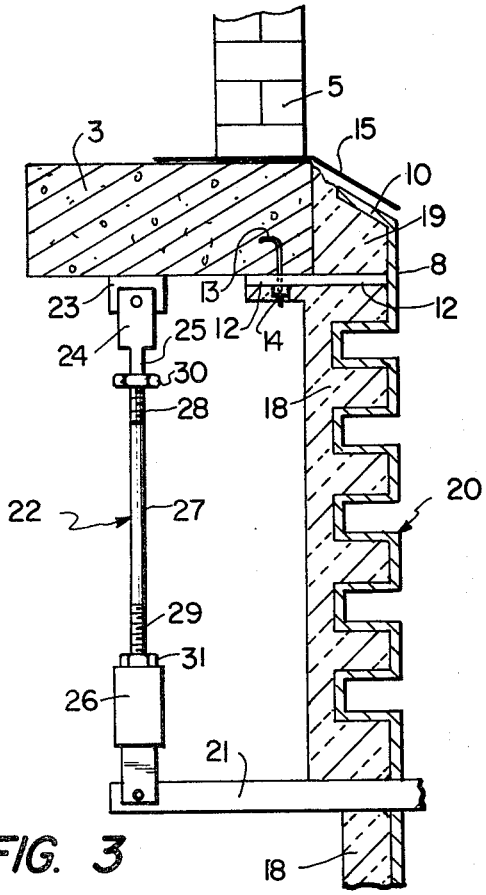
FIG. 3 is a cross sectional view of a portion of the upper part of the liner showing a modification incorporating an expansion section.

In these cases the spring hangers are not required, but may be employed, if desired, to reduce the load on the ring beam.

Where additional thermal expansion capacity is desired this can be readily accomplished by introducing an expansion joint and spring hangers in the vertical portion of steel liner 8, near the underside of ring beam 3. This modification is shown in FIG. 3 wherein expansion joint 20 is provided at the upper portion of steel liner 8, below ring plate 12. Joint 20 consists of a plurality of shaped corrugations which taken together form a bellows. Arm 21 is rigidity attached to 8 below the lowermost corrugation and extends laterally therefrom. Expansible hangers indicated generally by reference numeral 22 connects arm 21 to circular ring beam 3, as will be described in greater detail hereinafter. An upper connecting bracket 23 is rigidly attached to the underside of beam 3, as by an anchor bolt.

A clevis 24 having a dependent portion 25 is pivotally attached to bracket 23 by a pin or bolt, and has an internally threaded bore in the dependent portion. Arm 21 has pivotally attached thereto at its outer end an enclosed spring expansible means 26. The upper portion of 26 has an internally treaded portion. Rod 27 having threaded ends 28 and 29 are screwed into 26 and 25 and secured in place by nuts 30 and 31. The hangers are sized and spaced so that the door load of the suspended liner depresses the springs to their median position. While spring means are shown, other expansible hanger means may be employed, e.g. hydraulic or pneumatic. Similarly other types of expansion joints can be used such as viton-teflon, neoprene, etc.

Figure 4:
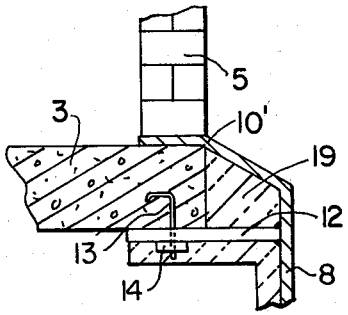
FIG. 4 shows in section a modification of the joint portion.

This method of suspension conserves the capacity of joint for expansion and rotation. The suspended portion of the liner can articulate in any direction, absorb vibration and take up differential expansion. In view of this articulating capacity, the joint between the brick and steel portion can be rigid. This is shown in FIG. 4 where the flared end 10' is imbedded in the brick liner.

What is claimed:

1. In a chimney having an outer column with an exterior and inner surface, in inner lining spaced therefrom and having a lower end, and breeching means joined to said lining, the improvement comprising:

a breeching member comprising an upright tubular element generally in line with the inner lining, and at least one lateral tubular element, said lateral element extending through the outer chimney column to form a breeching entry;

suspension means coacting with the outer chimney column and the upright tubular element for suspending the breeching member within the chimney at the lower end of the lining, and constant loading hanger means for suspending said lateral tubular element from the outer chimney column adjacent the breeching entry.

2. The chimney of claim 1 having a ring shaped circular beam supported at the inner surface of the column comprising supporting means for the inner lining, and means suspending the breeching member from said circular beam.

3. The chimney of claim 2 wherein the breeching member is suspended from the circular beam by means comprising lateral shoulder means securely fastened to the upper part of the vertical tubular element and attaching means fastening said shoulder means to the underside of said circular beam.

4. The chimney of claim 1 wherein said upright tubular element has an expansion section below the suspension means.

5. The chimney of claim 2 wherein said upright tubular element has an expansion section below the suspension means.

6. The chimney of claim 3 wherein said upright tubular element has an expansion section below the suspension means.

7. The chimney of claim 3 wherein said upright tubular eement has an expansion section below the suspension means and wherein the upper end of the tubular element is rigidly attached to the inner liner to form a rigid joint therewith.

8. The chimney of claim 3 wherein said means suspending the breeching member from the circular beam is adapted to permit relative movement between the inner liner and the breeching member.

9. In a chimney having an outer column with an exterior and inner surface, an inner lining spaced therefrom and having a lower end, and breeching means communicating with said lining, the improvement comprising:

an insulated breeching member comprising a tubular element generally in line with the inner lining, at least two lateral tubular elements disposed generally horizontally or at a slight obtuse angle to said vertical tubular element;

said breeching member being symetrical or substantially evenly balanced about its vertical axis;

said lateral tubular elements extending through the outer chimney column to form breeching entries; and suspension means coacting with the outer chimney column and the tubular elements for suspending the breeching member within the chimney at the lower end of the brick lining.

10. In a chimney having an outer column with an exterior and inner surface, an inner lining spaced therefrom and having a lower end, and breeching means joined to said lining, the improvement comprising:

a breeching member comprising an upright tubular element generally in line with the inner lining, and at least one lateral tubular element, said lateral element extending through the outer chimney column to form a breeching entry; and suspension means coacting with the outer chimney column and the upright tubular element for suspending the breeching member within the chimney at the lower end of the inner lining.

11. A chimney construction comprising an outer column and an inner liner radially inwardly spaced therefrom; the improvement comprising:

a support for said chimney disposed in direct supporting relation to at least said column, a base extending into the space between said liner and column; and thermally expandable and contractable means mounting said liner with respect to said base for accommodating expansion and contraction thereof.

12. The invention according to claim 11 wherein said base member extends to and is supported from said column, and wherein said liner is seated upon said base.

13. The invention according to claim 12, and a breeching member having a thermal connection with said liner and extending through an opening in said column.

14. The invention according to claim 11, and a tubular breeching element extending through said column, and said liner having a collar, and said breeching member being hung from said collar for communication with the liner and expanding and contracting relative thereto.

15. The invention according to claim 14, and resilient means floatingly suspending said breeching member from said chimney.

16. The invention according to claim 14, and said breeching member having a collar seated upon said liner collar.

17. In a chimney having an outer column with interior and exterior surfaces and upper and lower end portions, a base within the lower end portion, a liner within said column spaced from said interior surface and seated upon said base, means supporting said base, a tubular breeching member suspended from said base, and connecting means providing for relative thermal expansion and contraction between said base and said breeching member.

18. The invention according to claim 17, and said breeching member comprising a vertical tubular portion in alignment with the liner and having an upper end portion overlapping said base and thereby providing said thermal connecting means.

19. The invention according to claim 18, and means providing load hangers supporting said breeching member from said outer column.

20. The invention according to claim 17 wherein said breeching member has a portion formed as a series of corrugations.

21. The invention according to claim 19 and said hangers including clevis type connections to accommodate movement of said breeching member and thus reduce eccentric loads on the base due to loading weight of the breeching member.

22. The invention according to claim 20, and said series of corrugations being generally of bellows shape.

* * * * *